US007310888B2

(12) United States Patent
Gilliland

(10) Patent No.: US 7,310,888 B2
(45) Date of Patent: Dec. 25, 2007

(54) MASONRY STORY POLE WITH ADJUSTABLE BRACES

(76) Inventor: Jon T. Gilliland, 4002 Manor Dr., Stroudsburg, PA (US) 18360

( * ) Notice: Subject to any disclaimer, the term of this patent is extended or adjusted under 35 U.S.C. 154(b) by 647 days.

(21) Appl. No.: 10/928,855

(22) Filed: Aug. 27, 2004

(65) Prior Publication Data

US 2006/0059856 A1 Mar. 23, 2006

(51) Int. Cl.
*G01C 15/10* (2006.01)

(52) U.S. Cl. ..... 33/404

(58) Field of Classification Search ..... 33/404–410
See application file for complete search history.

(56) References Cited

U.S. PATENT DOCUMENTS

| | | | | | |
|---|---|---|---|---|---|
| 1,643,915 | A * | 9/1927 | Angelilli | 33/408 |
| 2,656,608 | A * | 10/1953 | Craig et al. | 33/406 |
| 2,728,142 | A * | 12/1955 | Betterton | 33/404 |
| 2,758,379 | A * | 8/1956 | Senk | 33/405 |
| 2,837,910 | A * | 6/1958 | Steed | 33/406 |
| 3,206,854 | A * | 9/1965 | Andrews | 33/406 |
| 3,348,312 | A * | 10/1967 | Jones | 33/406 |
| 4,077,127 | A | 3/1978 | Herrington | |
| 4,631,833 | A * | 12/1986 | Moye | 33/408 |
| 4,662,077 | A | 5/1987 | Richardson | |
| 4,866,851 | A | 9/1989 | Mills | |
| 4,995,167 | A | 2/1991 | Sanchez | |
| 5,996,238 | A * | 12/1999 | Yonke | 33/371 |
| 6,231,059 | B1 | 5/2001 | Cheldin | |
| 6,920,735 | B1 * | 7/2005 | Lambert et al. | 33/405 |
| 2007/0130878 | A1 * | 6/2007 | Davis | 33/407 |

FOREIGN PATENT DOCUMENTS

| | | | | |
|---|---|---|---|---|
| FR | 2560987 | A3 * | 9/1985 | 33/404 |

* cited by examiner

*Primary Examiner*—G. Bradley Bennett
(74) *Attorney, Agent, or Firm*—Kenneth P. Glynn, Esq.

(57) ABSTRACT

A masonry story pole with braces includes: a.) an elongated vertical pole member for corner positioning to set horizontal lines for bricklaying, having a working area between a top end and a bottom end; b.) a bottom support bracket connected to the bottom end of the pole member; c.) a working area bracket connected to the working area of the pole member; d.) two brace connection members with rotation mechanism for rotation about a vertical axis and about a horizontal axis; and, e.) at least two braces. The working area bracket has the two brace connection members connected to it. Further, each brace is rotatably connected to one of the two brace connection members, and extends downwardly therefrom so as to be positioned away from the pole member to provide adjustable angle brace positioning. The braces can be attached to either a horizontal surface or a vertical surface.

20 Claims, 5 Drawing Sheets

3
1
31
33
35

100
7
51
41
45
43
39
37
55
53
47
19
13
17
49
57
11
15
59
9
5
23
21
25

Figure 4
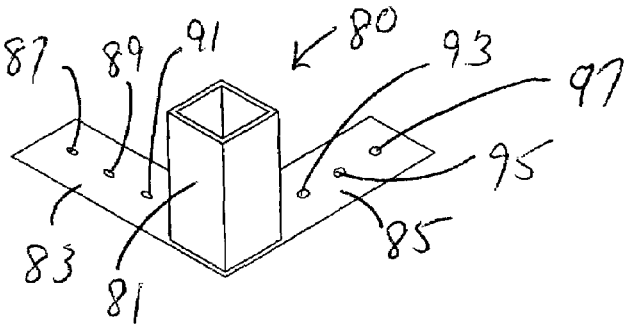
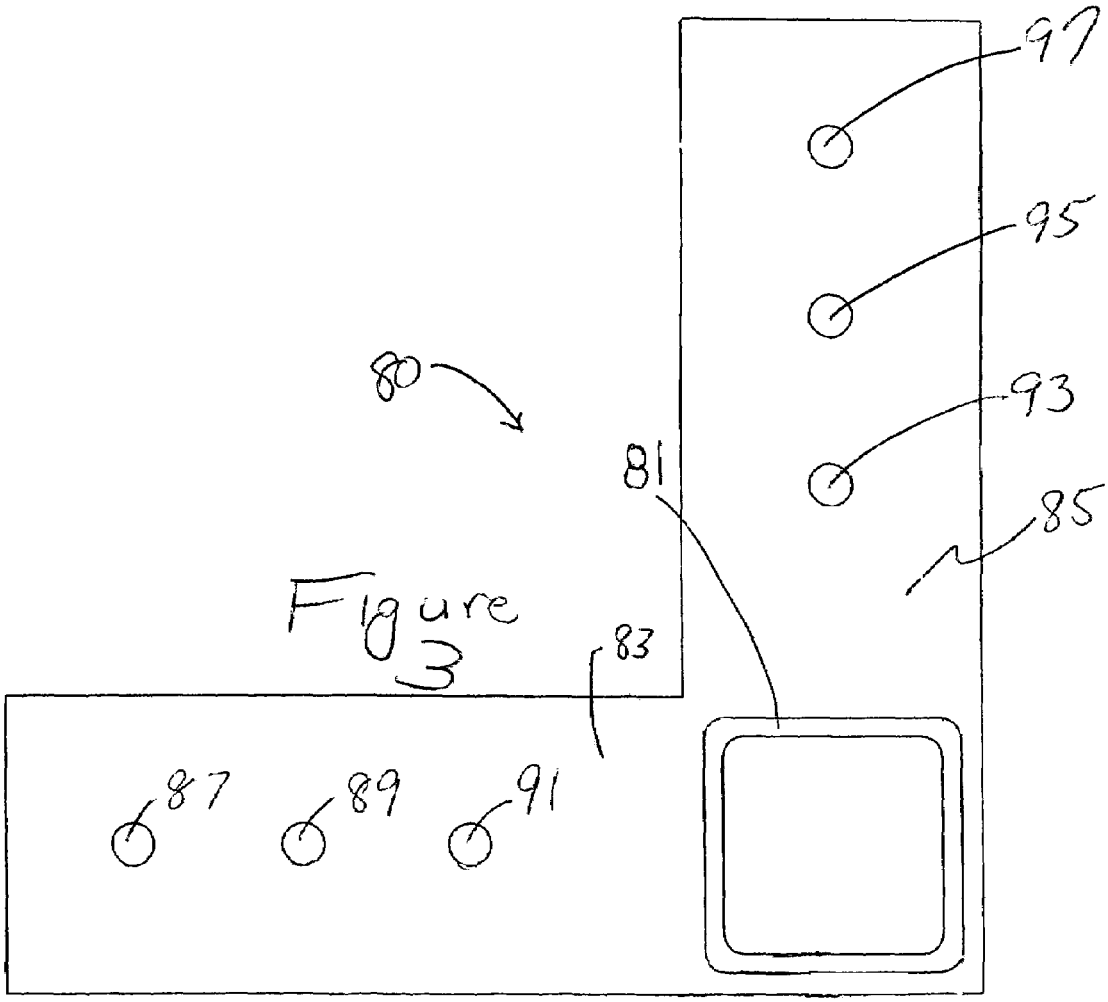
Figure 3

MASONRY STORY POLE WITH ADJUSTABLE BRACES

BACKGROUND OF THE INVENTION

1. Field of the Invention

The present invention relates to a new system for setting horizontal lines for bricklaying. By "bricklaying" is meant the sequential laying of construction block with interconnecting cement, adhesive, or other flowable, securing material. Construction blocks could be cinder blocks, bricks, glass blocks, ceramic blocks, stone or cut blocks, or the like. The invention is a masonry story pole that can be attached to foundations or lower laid block at any angle, but especially at an angle of 90 degrees. To create vertical corner poles so that strings or other lines may be connected as guides for the masonry workers. These guides create a straight line from a top view and may also be used for height delineation.

2. Information Disclosure Statement

The following prior art is representative of the state of the art in the field of masonry corner systems and story poles:

U.S. Pat. No. 4,995,167 describes a novel masonry tool kit that enables masons to plumb their work quickly and easily which saves time and money. The invention consists of two vertical members or story poles which operate in two systems. One system is used for outside corners and the other for inside corners. The vertical members or story poles have markings to save time so brick courses will be pregauged which prevents uneven courses on the wall. The lower L shaped members give stability so that the masonry line can be pulled tight and true with no movement. The masonry guide provides a simplified method of insuring accuracy with quality craftsmanship in masonry work. This masonry tool kit eliminates the need to shim or build a lead at the top of the foundation inside or outside corner as the lower L shaped members secure the vertical member or story pole in the correct position.

U.S. Pat. No. 4,886,851 describes a device for constructing walls of building blocks and the like. The device can be clamped down upon a corner block by turning a hand crank at the top of a long rod that extends above the top of the wall. Slide grips for a running line are provided that fit vertical flanges on the devices.

U.S. Pat. No. 4,662,077 describes a combination tool useful to a variety of building trades in building erection. The tool can be used as a story pole, a surveyor's rod, an extensible measuring device, a plumb and a horizontal level. When used as a measuring device, story pole or surveyor's grade rod, the tool of the present invention provides direct read capabilities eliminating the need for computations which in turn prevent errors in arithmetic commonly made when using tools of the prior art. The tool is particularly efficient for use in setting and erecting commercial store fronts typically constructed of aluminum and glass and effectively replaces at least five separate tools commonly used by the building trades.

The U.S. Pat. No. 4,007,127 describes a device to be used by brickmasons in the erection of a brick wall that embodies, speed in setting-up, precision and choice of the mortar joint spacing and is adjustable to a variety of wall heights.

Notwithstanding the prior art, the present invention is neither taught nor rendered obvious thereby.

SUMMARY OF THE INVENTION

The present invention relates to a masonry story pole with braces. It includes: a.) an elongated vertical pole member for corner positioning to set horizontal lines for bricklaying, the pole member having a bottom end, a top end, and a working area between the top end and the bottom end; b.) a bottom support bracket connected to the bottom end of the pole member, which includes a bottom attachment means for attachment to at least one of a horizontal surface and a vertical surface; c.) at least one working area bracket connected to the working area of the pole member; d.) two brace connection members with rotation means for rotation about a vertical axis and having rotation means for rotation about a horizontal axis; and, e.) at least two braces. The working area bracket has the two brace connection members connected to it. Further, each brace is rotatably connected to one of the two brace connection members, and extends downwardly therefrom so as to be positioned away from the pole member to provide adjustable angle brace positioning. Each of the two braces have brace attachment means for attachment to at least one of a horizontal surface and a vertical surface. In preferred embodiments, the brace attachment means may be attached to horizontal and/or vertical surfaces.

In some preferred embodiments of the present invention masonry story pole, the working area bracket is fixedly connected to the working area of the pole member, while in other embodiments, the working area bracket is moveably attached to the working area of the pole member, so as to provide for adjustable height positioning with lock/unlock or tighten/loosen features.

In some preferred embodiments, the masonry story pole has at least two braces that are adjustable in length. For example, the two braces may contain at least two sections.

In some preferred embodiments, the two sections of a brace have at least two sections that are telescopically connected to one another such that a section of the at least two sections slides within another section of the at least two sections.

In some preferred embodiments, the elongated pole member has a plurality of flat surfaces at right angles to each other and the at least one working area bracket has an L-shaped top view. For example, the bracket may be formed of two intersecting angle irons connected at right angles to one another.

In some preferred embodiments, the masonry story working area bracket has a T-shaped side view.

In some preferred embodiments, the elongated pole member bottom support bracket has an L-shaped top view. In some preferred embodiments, the bottom support bracket has two extended flanges at right angles to one another and each of the two extended flanges has at least one anchoring orifice.

BRIEF DESCRIPTION OF THE DRAWINGS

The present invention should be more fully understood when the specification herein is taken in conjunction with the drawings appended hereto wherein:

FIG. 3 illustrates a top view of one embodiment of a bottom support bracket for a present invention masonry story pole with adjustable braces, and FIG. 4 shows an oblique view thereof;

DETAILED DESCRIPTION OF THE PRESENT INVENTION

Figure 1:
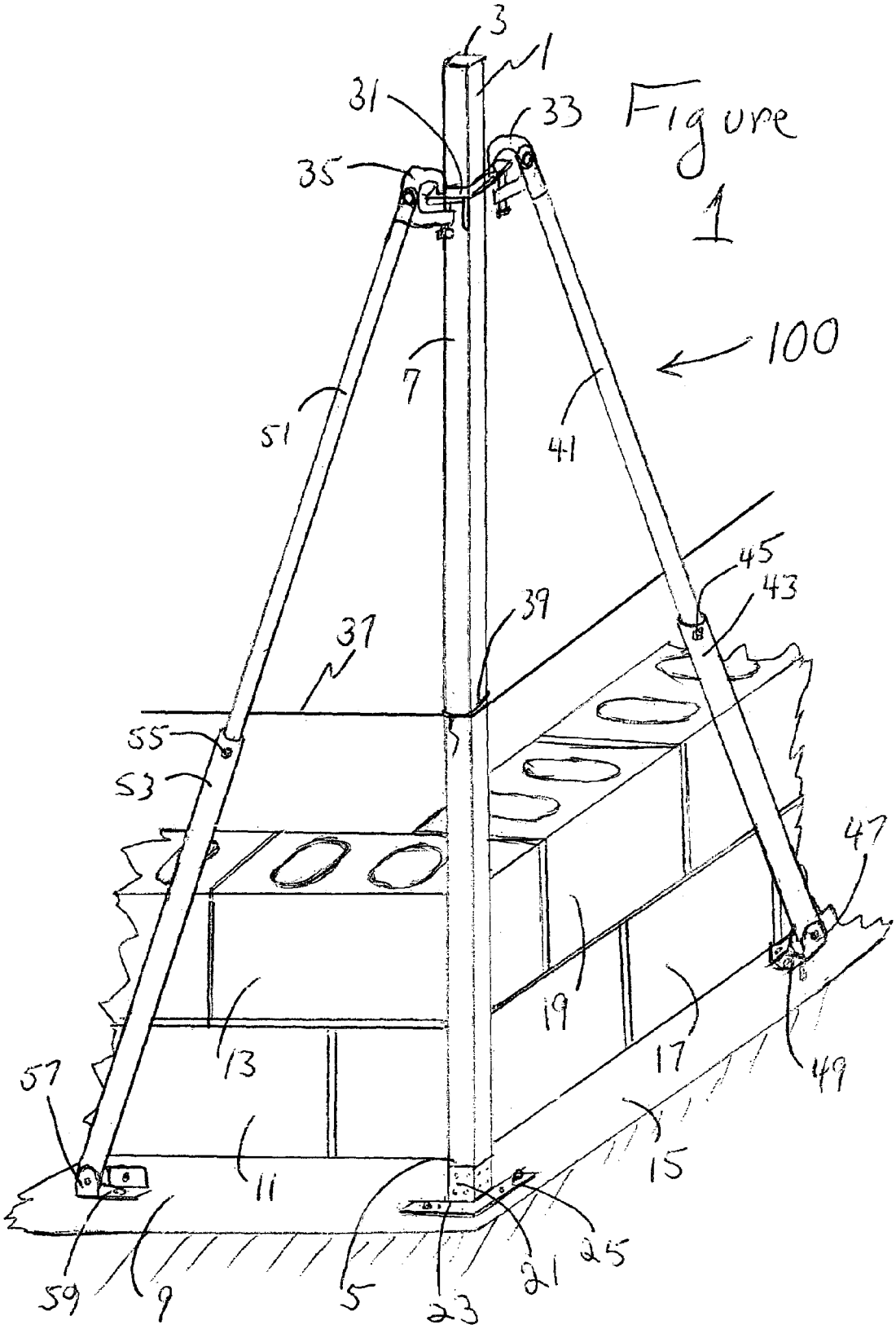
FIG. 1 shows an oblique front view of a present invention masonry story pole with adjustable braces in use for an outside corner.

The present invention should be more fully understood when the specification herein is taken in conjunction with the drawings appended hereto wherein:

FIG. 1 shows an oblique front view of a present invention masonry story pole, shown generally as device 100 in use for an outside corner. Device 100 includes the elongated vertical pole member 1, which may be circular in cross section, square, rectangular, or otherwise. It may be solid or hollow and could be plastic, metal, composite, or otherwise. For maximum efficiency and corrosion resistance with lightweight but durable characteristics, aluminum metal is preferred.

Elongated vertical pole member 1 has a top end 3 and a bottom end 5 and includes a work area 7 located between top end 3 and bottom end 5. This is referred to as a work area because it is a region where a bracket is attached, as well as a general area where horizontal lines are attached or connected.

FIG. 1 shows a front foundation 9 and a side foundation 15 with a first front course of blocks 11 (left to right) and a first side course of blocks 17 (front to back). A second front course of blocks 13 and a second side course of blocks 19 are also shown.

Elongated vertical pole member 1 has connected to its bottom end 5, a bottom support bracket 21 with right angle flanges 23 and 25 secured to front foundation 9 and side foundation 15, as shown. In this embodiment, the bottom support bracket 21 is screwed to elongated vertical pole member 1, but as shown in subsequent figures, this bottom bracket could alternatively be a "slide onto" or "slide into" support bracket.

At work area 7 of elongated vertical pole member 1 is a working area bracket 31. This is an L-shaped bracket from its top view, but if elongated vertical pole member 1 were circular, this bracket could be a circular flange.

Connected to working area bracket 31 are custom C-clamps 33 and 35. They may be rotated in the horizontal plane when loosened and tightened and have a hinge point with the braces 41 and 51, respectively, so that these C-clamps (brace connection members) provide rotational capabilities for the braces both in a vertical plane and a horizontal plane.

Braces 41 and 51 are used to anchor, stabilize and vertically level elongated vertical pole member 1. This is accomplished by anchoring the lower ends of the braces to either a foundation or other horizontal support, or a course of block or other support, or both.

The two braces 41 and 51 will now be described in parallel. The braces, respectively, include lower sections 43 and 53, adjustment fasteners 45 and 55, and brace attachment means 47 and 57 with anchoring flanges 49 and 59, as shown.

Once the device 100 is set up as shown, or aversely for an inside corner, a guideline such as string 37 is wrapped or tied 39 around elongated vertical pole member 1 and attached to other corner poles and made level at the desired height.

The present invention allows for a fast yet strong setup that both saves time and increases the accuracy of the work.

Figure 2:
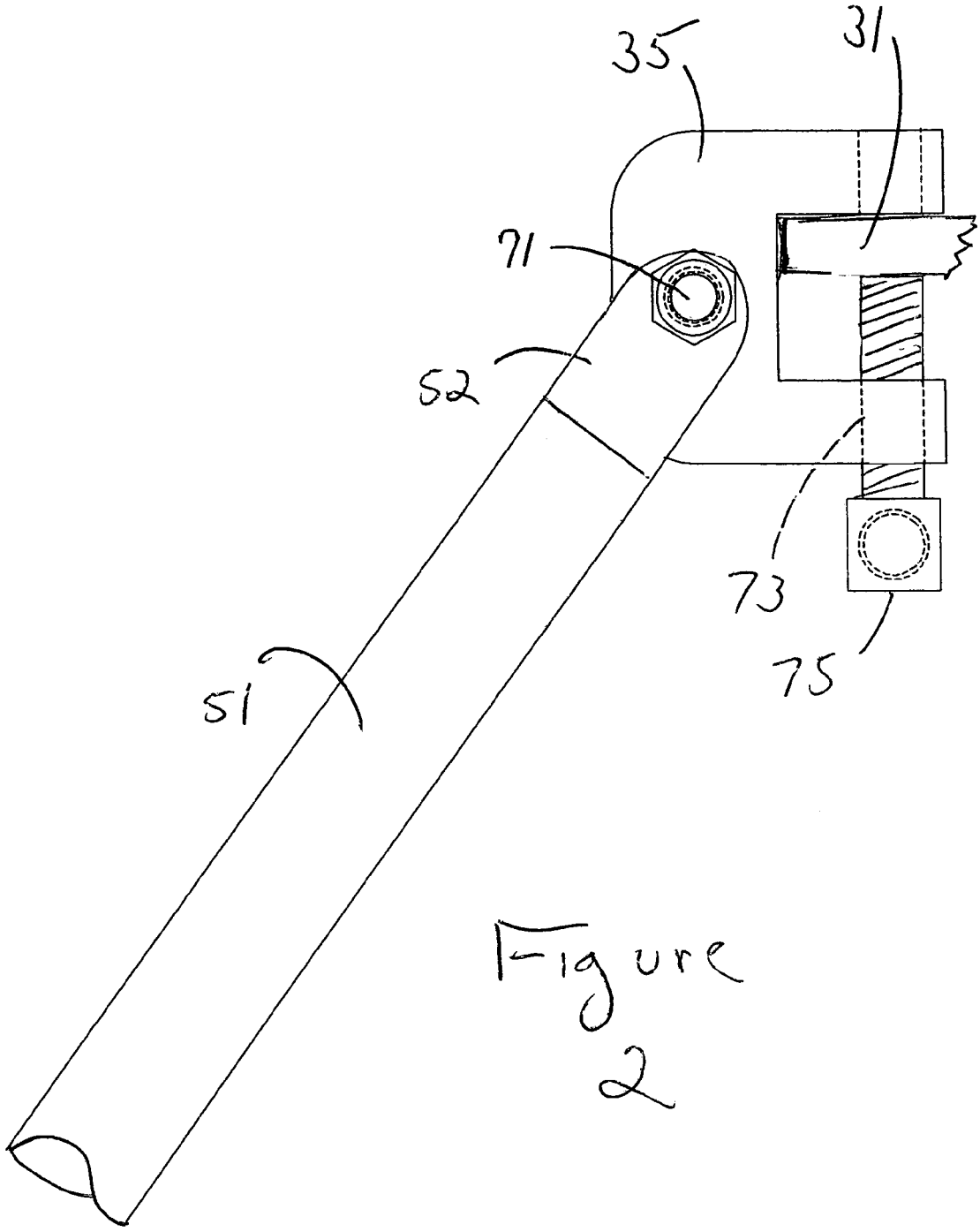
FIG. 2 shows a front blown up view of one embodiment of the present invention device shown in FIG. 1.

FIG. 2 shows a front blown up partial view of one embodiment of the present invention device brace connection member 35 and components to which it is connected, as shown in FIG. 1. The C-clamp 35, also generally known as a brace connection member, is connected to working area bracket 31 by tightened bolt 75 through clamp threaded orifice 73. The top of C-clamp 35 and the end of bolt 75 will tighten and lock onto working area bracket 31, as shown. When bolt 75 is loosened, C-clamp 35 may be swiveled, i.e., rotated to change the top view angle of brace 51 and then re-tightened to lock it in.

Additionally, C-clamp 35 has a hole through which bolt 71 may pass for tightening with a complementary nut. Bolt 71 will first pass through flattened and drilled end 52 of brace 51, as shown.

FIG. 3 illustrates a top view of one embodiment of a bottom support bracket 80 for a present invention masonry story pole, and FIG. 4 shows an oblique view thereof. Bottom support bracket 80 includes a square riser 81 for supporting the elongated vertical pole member of a present invention device. Square riser 81 could be designed to fit into a hollow vertical pole member or designed for a pole member to fit into it. Further, the square riser 81 that is shown is based on a tight fit with no ancillary fasteners. However, bolts, wing screws or other lock/unlock mechanisms could be included. Flange 83 and flange 85 each have a plurality of orifices for nailing or bolting or otherwise attaching to a foundation.

Figure 5:
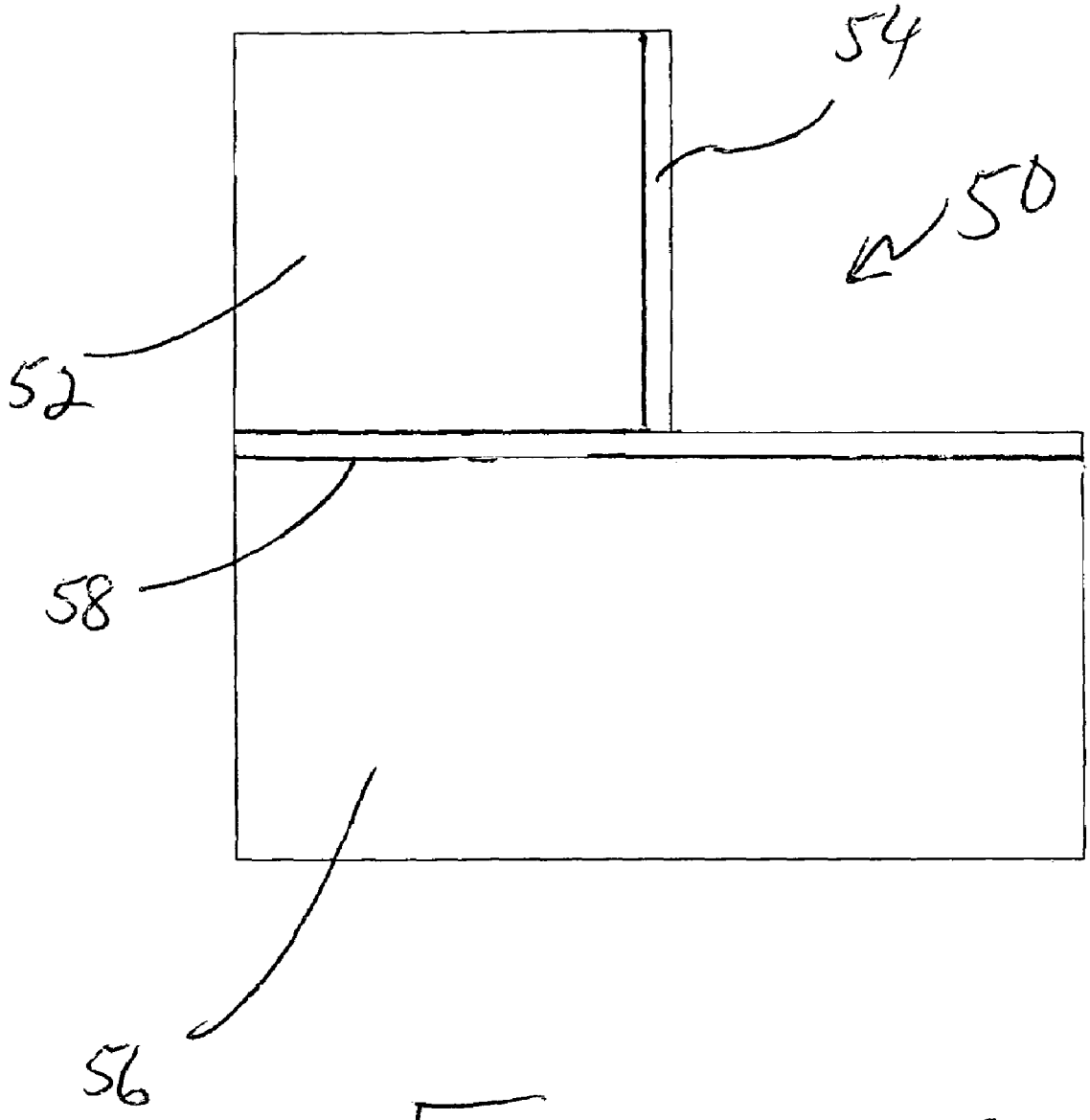
FIG. 5 shows a bottom view of one embodiment of a working area bracket used in a present invention device.

While flanges 83 and 85 are flat (horizontal), they could be angle irons with both flat and upright (vertical) elements to provide for both vertical and/or horizontal attachment. (The phrase "angle irons" as used herein refers to FIG. 5 shows a bottom view of one embodiment of a working area bracket 50, used in a present invention device. Bracket 50 includes an angle iron section 52 with downwardly extending wall 54, connected to angle iron section 56 with downwardly extending wall 58. This brace 52 is similar to the bracket 31 shown in FIG. 1, and may be used in a similar fashion, either permanently fixed or removeably attached to the pole member.

Figure 6:
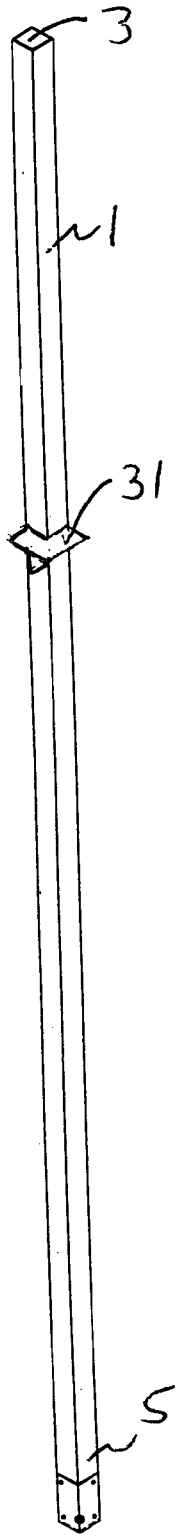
FIG. 6 shows a front view of a present invention device elongated vertical pole member; and, FIG. 7 shows a front view of a telescopic brace used in one preferred present invention device.

FIG. 6 shows a front view of a present invention device elongated vertical pole member 1 shown in FIG. 1 with identical parts identically numbered.

Figure 7:
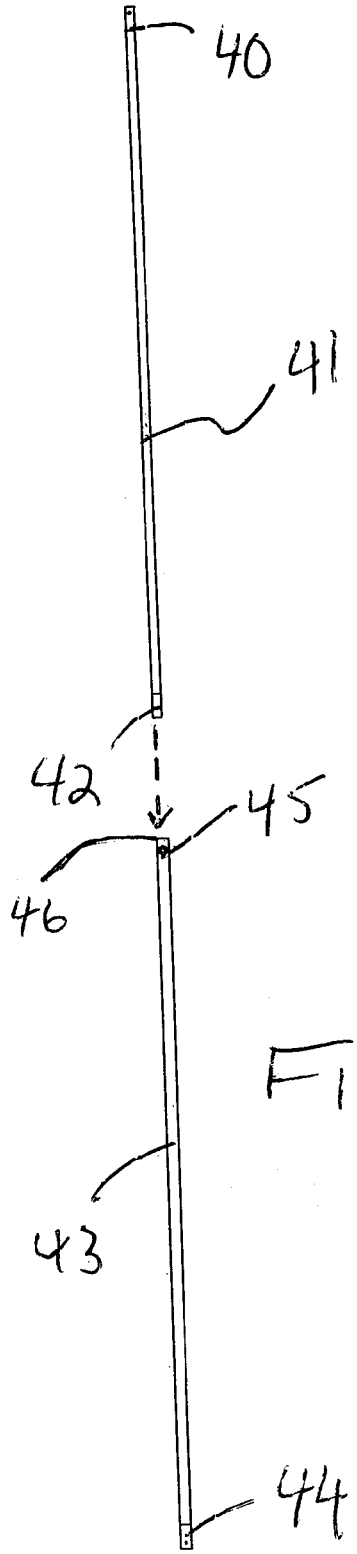

FIG. 7 shows a front view of a the two telescopic brace section 41 and 43 used FIG. 1, with identical parts identically numbered. Bottom end 42 of brace section 41 is inserted into top end 46 of brace section 43 to create an adjustable telescopic brace. The top end 40 is attached to a brace connection member, and bottom end 44 is attached to a bottom attachment means.

Obviously, numerous modifications and variations of the present invention are possible in light of the above teachings. For example, the bottom support bracket 21 (FIG. 1) could have horizontal and vertical plate segments with attachment orifices so that either a bottom (floor or foundation) or side (wall or structure) attachment could be accomplished with a single device. Also, the anchoring flanges 49 and 59 that secure the braces may be arranged differently from those shown. For example, they may be horizontal or vertical or, preferably, be a combined horizontal/vertical device that could be attached with a C-clamp as shown at the top ends of the braces.

String 37 (FIG. 1) is simplistically shown as tied to the pole 1. However, professionals would use masonry line blocks to effectively and accurately affix and align the working lines (strings). These are used to hold the lines by tension, without the need to tie or untie the lines. These devices are commercially available and well known to the masonry trades. Other variations within the purview of the artisan could also be made. It is therefore understood that within the scope of the appended claims, the invention may be practiced otherwise than as specifically described herein.

What is claimed is:

1. A masonry story pole with braces, which comprises:

a.) an elongated vertical pole member for corner positioning to set horizontal lines for bricklaying, said pole member having a bottom end, a top end, and a working area between said top end and said bottom end;

b.) a bottom support bracket connected to said bottom end of said pole member, said bottom support bracket including bottom attachment means for attachment to at least one of a horizontal surface and a vertical surface;

c.) at least one working area bracket connected to said working area of said pole member, said at least one working area bracket having at least two brace connection members connected thereto;

d.) said at least two brace connection members, each of said brace connection members having rotation means for rotation about a vertical axis and having rotation means for rotation about a horizontal axis;

e.) at least two braces, each said brace being rotatably connected to one of said at least two brace connection members, and extending downwardly therefrom so as to be positioned away from said pole member to provide adjustable angle brace positioning, each of said at least two braces having brace attachment means for attachment to at least one of a horizontal surface and a vertical surface.

2. The masonry story pole with braces of claim 1 wherein said at least one working area bracket is fixedly connected to said working area of said pole member.

3. The masonry story pole with braces of claim 1 wherein said at least one working area bracket is moveably attached to said working area of said pole member.

4. The masonry story pole with braces of claim 1 wherein each of said at least two braces are adjustable in length.

5. The masonry story pole with braces of claim 4 wherein each of said at least two braces contain at least two sections.

6. The masonry story pole with braces of claim 5 wherein each of said at least two sections are telescopically connected to one another such that a section of said at least two sections slides within another section of said at least two sections.

7. The masonry story pole with braces of claim 1 wherein said elongated pole member has a plurality of flat surfaces at right angles to each other and said at least one working area bracket has an L-shaped top view.

8. The masonry story pole with braces of claim 7 wherein said at least one working area bracket has a T-shaped side view.

9. The masonry story pole with braces of claim 1 wherein said elongated pole member bottom support bracket has an L-shaped top view.

10. The masonry story pole with braces of claim 9 wherein said bottom support bracket has two extended flanges at right angles to one another and each of said two extended flanges has at least one anchoring orifice.

11. A masonry story pole with braces, which comprises:

a.) an elongated hollow vertical metal pole member for corner positioning to set horizontal lines for bricklaying, said pole member having a bottom end, a top end, and a working area between said top end and said bottom end;

b.) a bottom support bracket connected to said bottom end of said pole member, said bottom support bracket including bottom attachment means for attachment to at least one of a horizontal surface and a vertical surface;

c.) at least one working area bracket connected to said working area of said pole member, said at least one working area bracket being two angle iron sections connected to one another at a right angle to create an L-shaped top view, said at least one working area bracket having at least two brace connection members connected thereto;

d.) said at least two brace connection members, each of said brace connection members having rotation means for rotation about a vertical axis and having rotation means for rotation about a horizontal axis, each of said two brace connection members being hollow metal;

e.) at least two braces, each said brace being rotatably connected to one of said at least two brace connection members, and extending downwardly therefrom so as to be positioned away from said pole member to provide adjustable angle brace positioning, each of said at least two braces having brace attachment means for attachment to at least one of a horizontal surface and a vertical surface.

12. The masonry story pole with braces of claim 11 wherein said at least one working area bracket is fixedly connected to said working area of said pole member.

13. The masonry story pole with braces of claim 11 wherein said at least one working area bracket is moveably attached to said working area of said pole member.

14. The masonry story pole with braces of claim 11 wherein each of said at least two braces are adjustable in length.

15. The masonry story pole with braces of claim 14 wherein each of said at least two braces contain at least two sections.

16. The masonry story pole with braces of claim 15 wherein each of said at least two sections are telescopically connected to one another such that a section of said at least two sections slides within another section of said at least two sections.

17. The masonry story pole with braces of claim 11 wherein said elongated pole member has a plurality of flat surfaces at right angles to each other.

18. The masonry story pole with braces of claim 11 wherein said at least one working area bracket has a T-shaped side view.

19. The masonry story pole with braces of claim 11 wherein said elongated pole member bottom support bracket has an L-shaped top view.

20. The masonry story pole with braces of claim 10 wherein said bottom support bracket has two extended flanges at right angles to one another and each of said two extended flanges has at least one anchoring orifice.

* * * * *